United States Patent [19]

Baghdasarian

[11] Patent Number: 4,654,671

[45] Date of Patent: Mar. 31, 1987

[54] SELF-ALIGNING TORQUE TRANSMITTING HINGE

[75] Inventor: Varouj G. Baghdasarian, Cupertino, Calif.

[73] Assignee: Ford Aerospace & Communications Corporation, Detroit, Mich.

[21] Appl. No.: 613,695

[22] Filed: May 24, 1984

[51] Int. Cl.[4] ..... H01Q 15/20

[52] U.S. Cl. ..... 343/915; 16/366

[58] Field of Search ..... 343/765, 912, 915, 916, 343/840; 16/366, 367

[56] References Cited

U.S. PATENT DOCUMENTS

| | | | |
|---|---|---|---|
| 2,740,962 | 4/1956 | Hammond | 343/765 |
| 2,987,332 | 6/1961 | Bonmartini | 287/85 |
| 3,179,447 | 4/1965 | Parr et al. | 285/114 |
| 4,151,872 | 1/1979 | Slysh et al. | 160/213 |
| 4,155,524 | 5/1979 | Marello et al. | 244/173 |
| 4,315,265 | 2/1982 | Palmer et al. | 343/915 |

*Primary Examiner*—Eli Lieberman

*Attorney, Agent, or Firm*—Edward J. Radlo; Keith L. Zerschling

[57] ABSTRACT

A hinge (5) having a first, relatively stationary yoke (8) and a second, relatively rotating yoke (10). A torquing means (17) fixed with respect to the first yoke (8) transmits torque to the second yoke (10) via a block (18) retained within a cavity (20) of an elongated hinge pin (15) that is aligned along the axis of rotation (z) of the two yokes (8, 10). The torquing means (17) is coupled to the hinge pin (15). The yokes (8, 10) self-align about two orthogonal axes (x, y) that are also orthogonal to the axis of rotation (z). The block (18) is free to pivot within the cavity (20) about the x axis, while the second yoke (10) is free to pivot about the y axis about the hinge pin (15) and block (18).

6 Claims, 7 Drawing Figures

ROTATION ABOUT x AXIS

ROTATION ABOUT y AXIS

SELF-ALIGNING TORQUE TRANSMITTING HINGE

TECHNICAL FIELD

This invention pertains to the field of self-aligning hinges which transmit torque between first and second members, causing relative rotation between said members about an axis.

BACKGROUND ART

U.S. Pat. No. 2,987,332 shows a resilient hinge pin in its structure, unlike the rigid hinge pin (15) in the present invention. The referenced hinge does not have a rotationally free joint, and torque cannot be applied to the hinge pin and transmitted to the rotating part.

U.S. Pat. No. 3,179,447 shows a limited movement standard hinge that is self-aligning about one axis only, not two axes as in the present invention. The cited hinge cannot have rotational torque applied through the pin itself, unlike the present invention.

U.S. Pat. No. 4,151,872 discloses a pane deployment system that uses standard single axis hinges. It is not a hinge structure by itself, but rather, a means for deploying and retracting lightweight panels using a tape and sprocket mechanism, having standard hinges which do not self-align about any axis.

U.S. Pat. No. 4,155,524 discloses a panel unfolding mechanism employing standard hinges and a cable and pulley mechanism, for deploying stacked panels. The hinges are not self-aligning, and deployment torque is not applied to the hinge pins.

DISCLOSURE OF INVENTION

The hinge (5) of the present invention self-aligns about two orthogonal axes (x, y), providing relative rotation between a first, relatively stationary yoke (8) and a second, relatively moving second yoke (10) about a torquing axis (z) orthogonal to each of the alignment axes (x, y). Torque is applied by a torquing means (17) to a hinge pin (15) aligned along the torquing axis (z). There is no torsional windup at the hinge pin (15).

Torquing means (17) directly applies clockwise or counter-clockwise rotational power to the hinge pin (15). The torque is then transmitted to the relatively moving yoke (10), which may be attached to a panel (3, 4), e.g., on a folding antenna reflector (1).

When torque is not applied to the hinge (5), the hinge (5) can be used as an untorqued hinge that self-aligns about three orthogonal axes (x, y, z).

The relatively stationary yoke (8) comprises a pair of sleeves (21, 31) axially aligned along the torquing axis (z). The relatively rotating yoke (10) comprises a sleeve (23) positioned between the two sleeves (21, 31) of the relatively stationary yoke (8) in axial alignment therewith. The hinge pin (15) fits within the three sleeves (21, 23, 31).

A torque transmitting block (18) fits within an interior cavity (20) of the hinge pin (15). The block (18) has a first set of pins (40, 41) aligned along the first alignment axis (x) and a second set of alignment pins (50, 51) aligned along the second alignment axis (y).

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
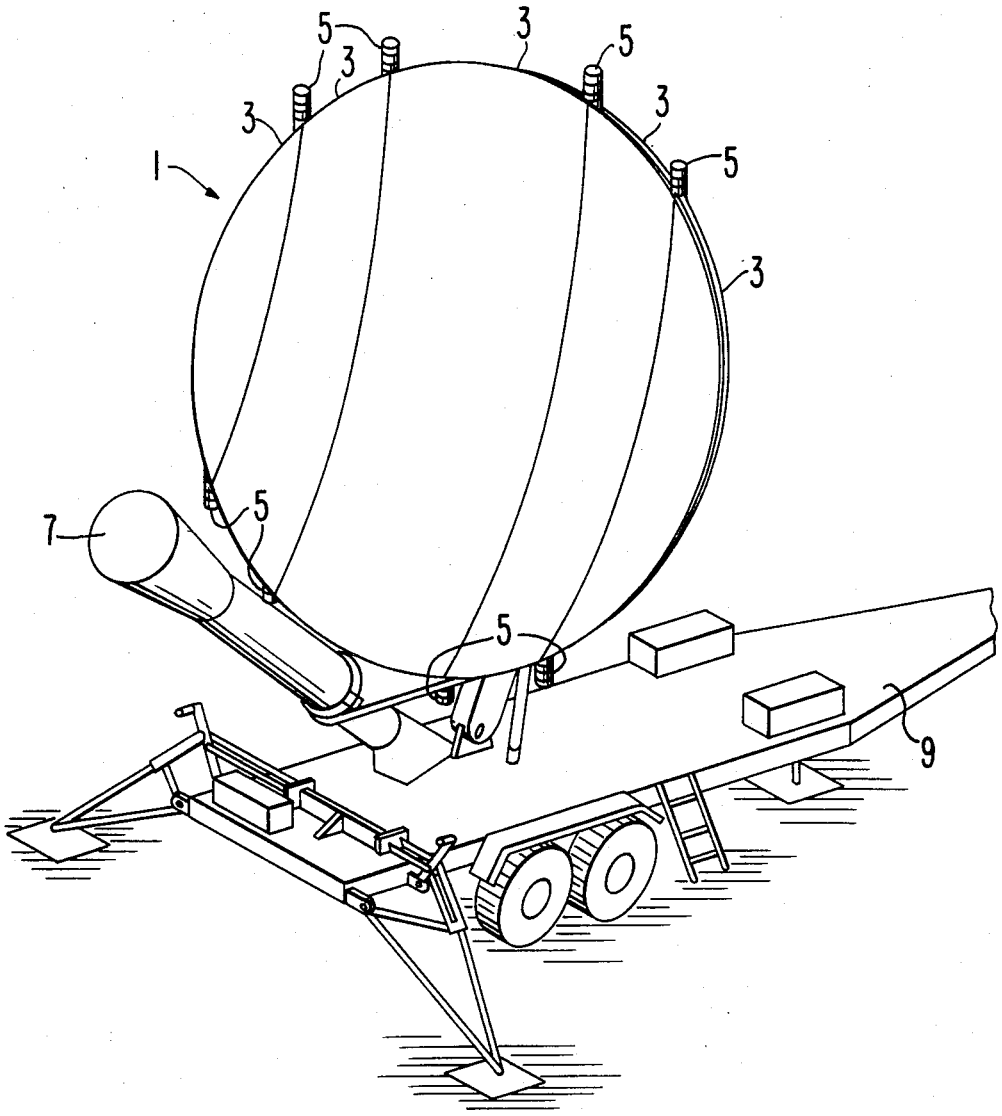
FIG. 1 is a elevational view of a deployable antenna reflector 1 using hinges 5 of the present invention.

FIG. 1 illustrates one of the many applications for hinge 5 of the present invention: rapid folding and unfolding an antenna reflector 1 consisting of several panels 3. The antenna reflector 1 is mounted on a platform 9 and is fed by feed horn 7. Hinges 5 are employed at opposing ends of each axis of relative rotation separating adjacent panels 3. FIG. 1 illustrates reflector 1 in its deployed state: a portion of a paraboloid. When panels 3 are activated by hinges 5, reflector 1 is folded into a much smaller volume, facilitating its storage and transport.

If a standard single axis or single degree of freedom hinge were used for this purpose, distortion in the surface of the antenna reflector 1 could occur due to misalignment of the hinge axes, thereby causing degradation of the reflector 1 surface accuracy, degradation of the electromagnetic performance of reflector 1, and excessive stresses that could eventually cause failure of the hinges or panels 3.

On the other hand, hinge 5 of the present invention is well suited for such an antenna reflector 1 because torque is transmitted through each hinge 5 allowing powered deployment of the reflector 1, and the self-aligning capability of each hinge 5 minimizes panel 3 distortions.

Figure 2:
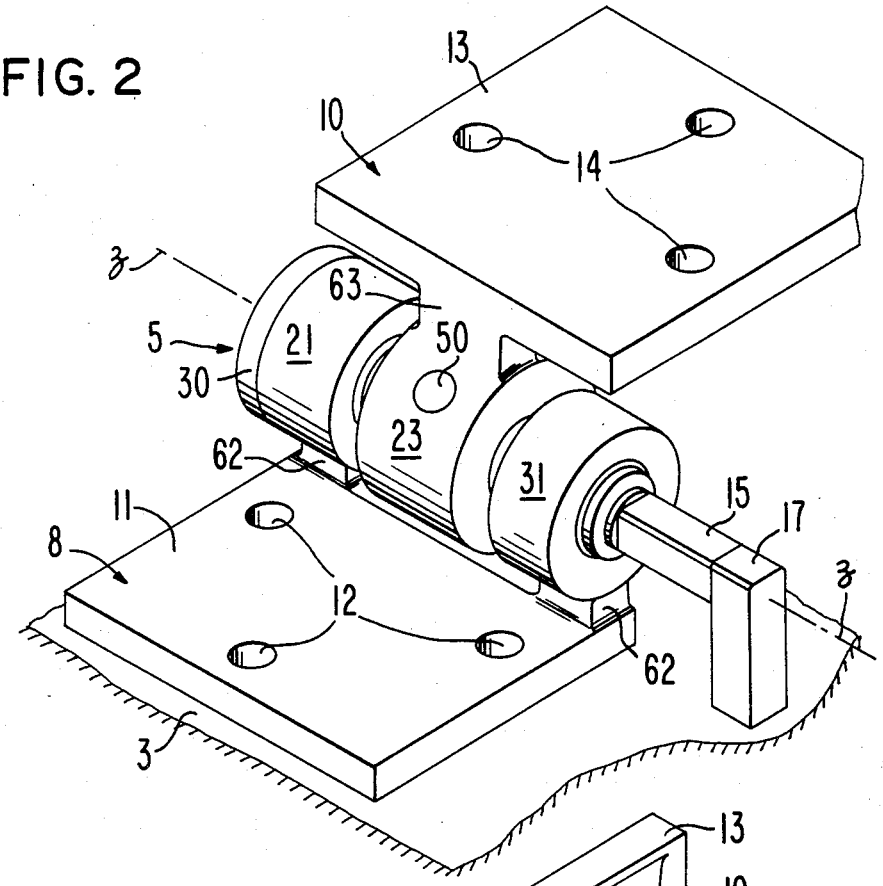
FIG. 2 is an elevational view of a first embodiment of hinge 5.
Figure 3:
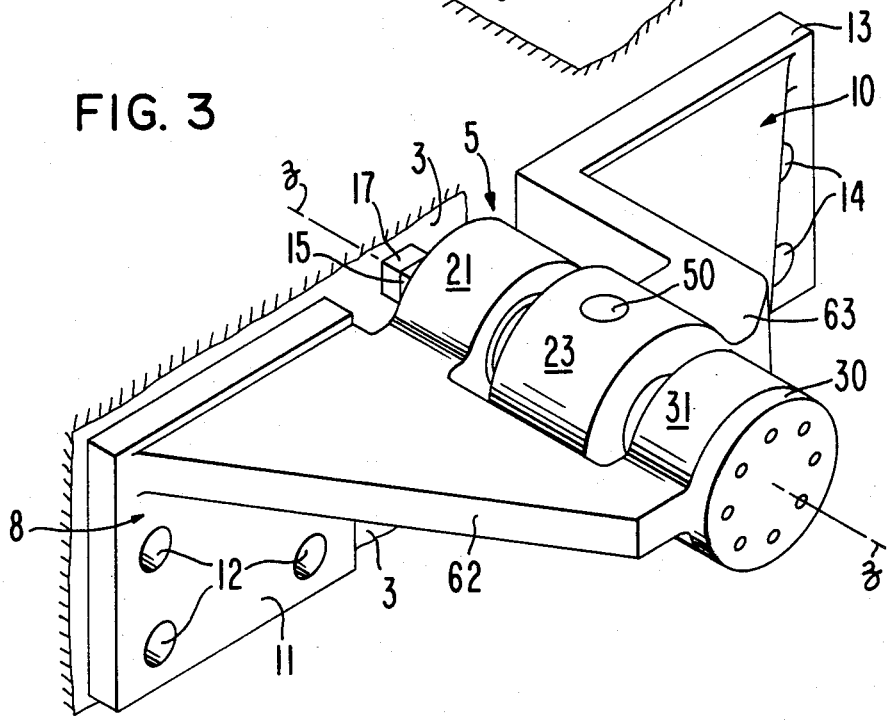
FIG. 3 is an elevational view of a second embodiment of hinge 5.

FIGS. 2 and 3 show that each hinge 5 consists of a first, relatively stationary, yoke 8 and a second, relatively moving, yoke 10. Yokes 8 and 10 rotate with respect to each other about an axis of rotation z, which is also the torquing axis because torque is applied to this axis by torquing means 17 fixedly mounted with respect to relatively stationary yoke 8. Yoke 8 is said to be "relatively" stationary because the panel 3 to which it is attached can be rotating with respect to another panel 3.

Yoke 8 comprises a generally flat mounting plate 11, mounting means 12 (which in the illustrations are holes) for mounting plate 11 to panel 3, two generally hollowed-out cylindrical sleeves, 21 and 31, axially aligned along the z axis, and two necks 62 rigidly interconnecting plate 11 with the sleeves 21, 31. As seen from the various drawings, necks 62 can assume many possible configurations; the orientation of sleeves 21, 31 with respect to plate 11 is not critical.

Yoke 10 comprises a generally flat mounting plate 13, mounting means 14 (which in the illustrations are holes) and a sleeve 23, generally in the shape of a hollowed-out cylinder, fixedly mounted to plate 13 by means of neck 63. Sleeve 23 is disposed about the z axis, interspersed between sleeves 21 and 31 in alignment therewith. As seen from the various drawings, neck 63 can assume many possible configurations; the orientation of sleeve 23 with respect to plate 13 is not critical.

Elongated hinge pin 15 is disposed along the z axis and rotates thereabout within sleeves 21, 23, and 31.

Torquing means 17, which may be a motor or a handcrank for manual operation, is coupled directly to hinge pin 15 for imparting torque about the z axis, and is fixedly mounted with respect to yoke 8; in FIGS. 2 and 3, torquing means 17 and plate 11 are both mounted onto panel 3. Activation of torquing means 17 provides clockwise or counter-clockwise rotation of hinge pin 15, causing corresponding rotation of yoke 10 with respect to yoke 8. During and after torquing, hinge 5 self-aligns about two orthogonal alignment axes, x and y, which are orthogonal to each other and to the z axis.

Figure 4:
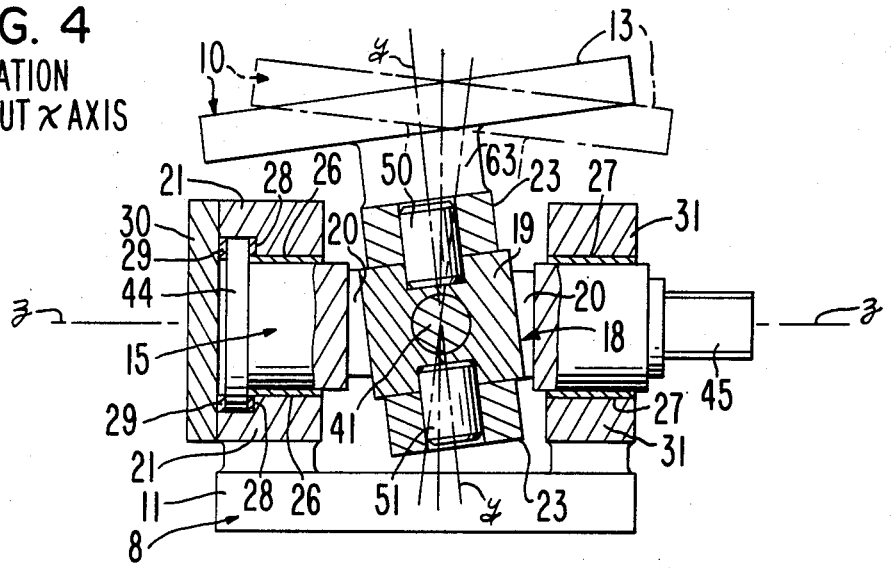
FIG. 4 is a partial cross-section view, looking down the x axis, of a third embodiment of hinge 5 very similar to the first embodiment depicted in FIG. 2.
Figure 5:
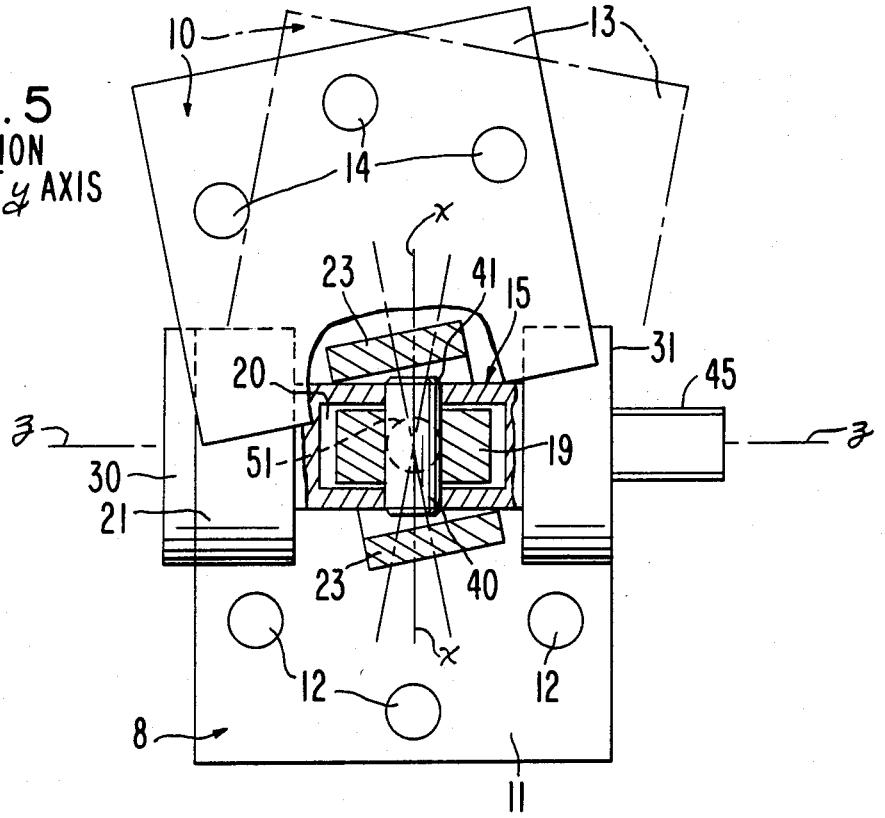
FIG. 5 is a partial cross-section view, looking down the y axis, of said third embodiment of hinge 5.
Figure 6:
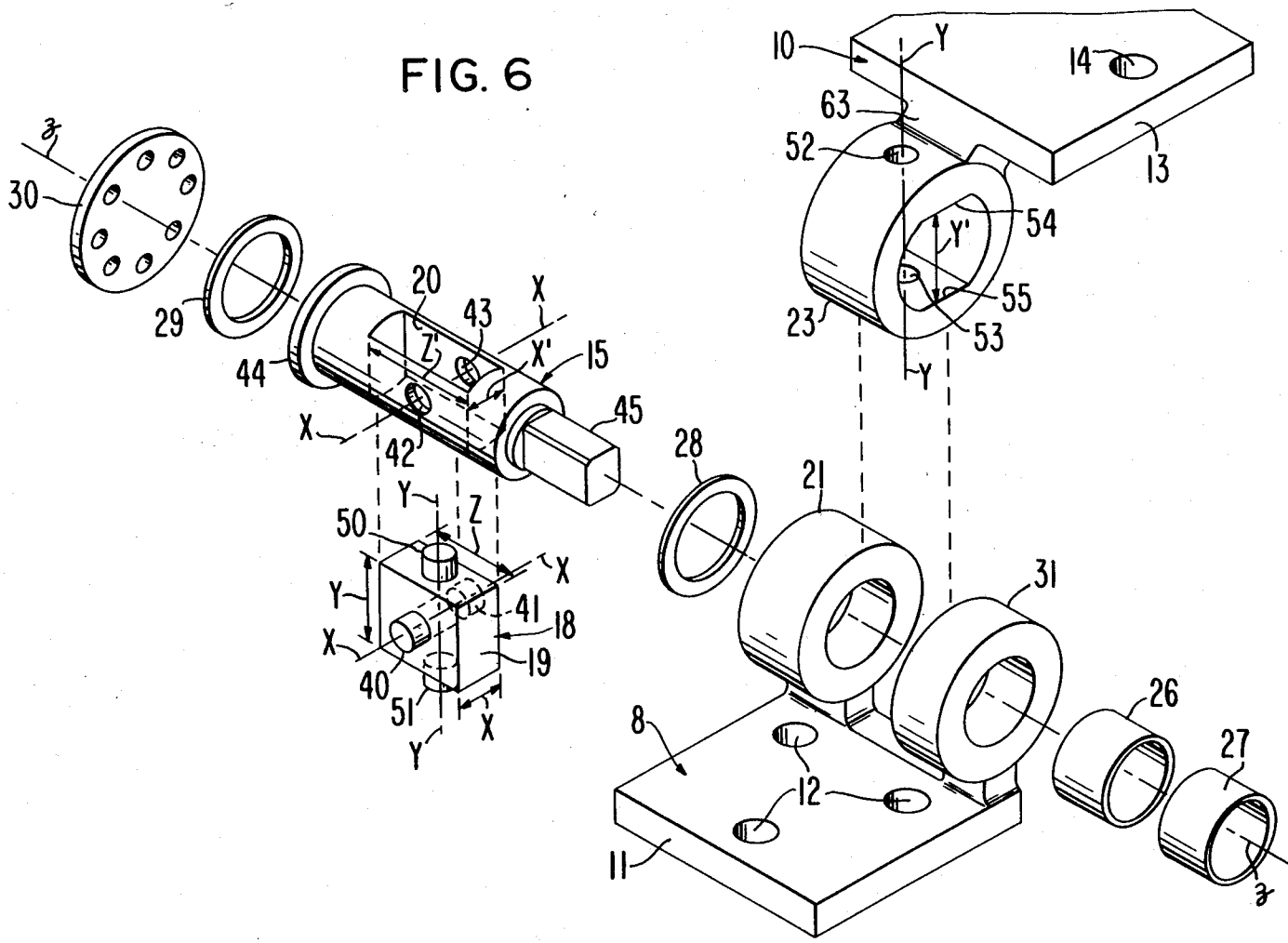
FIG. 6 is an exploded elevational view of said third embodiment of hinge 5.

The x, y, and z axes are identified in FIGS. 4, 5, and 6, which show details of a third embodiment of the operation of hinge 5. The x and y axes are fixed with respect to torque transmitting block 18. The z axis is fixed with respect to hinge pin 15. In FIGS. 4 and 5, the dotted lines showing yoke 10 illustrate alternative locations of yoke 10 as FIG. 4 illustrates the partial rotation of yoke 10 and block 18 about the x axis during self-alignment of hinge 5, and FIG. 5 illustrates the partial rotation of yoke 10 about hinge pin 15 and the y axis during self-alignment of hinge 5.

Hinge pin 15 consists of an elongated shaft 45 attached to torquing means 17, a central generally cylindrically-shaped region that has been cut through to form a central cavity 20, and an end flange 44. Flange 44 fits between thrust bearings 29 and 28, e.g., washers, within a recessed portion at the left of sleeve 21. Bearings 28, 29 absorb loads along the z axis. End plate 30 keeps hinge pin 15 in place, and keeps lubrication within the recesses of sleeve 21. Bushing 26 fits between hinge pin 15 and sleeve 21, and bushing 27 fits between hinge pin 15 and sleeve 31. Bushings 26 and 27 absorb radial loads.

Torque transmitting block 18 fits within cavity 20. Block 18 comprises a central mass 19 (shown here as having the shape of a rectangular prism), a first set of alignment pins 40, 41 displaced along the x axis, and a second set of alignment pins 50, 51 disposed along the y axis. FIGS. 4–6 show the x axis alignment pins as being a single pin, the front of the pin being referred to as pin 40, the rear of the pin being referred to as pin 41. Pins 40, 41, 50, and 51 are rigidly mounted on mass 19.

Pins 40, 41 fit snugly within corresponding holes 42, 43, respectively, aligned along the x axis and connecting cavity 20 with the outside of hinge pin 15. Pins 40, 41 are free to rotate but not to wobble within holes 42, 43. Similarly, y axis pins 50, 51 fit snugly within corresponding holes 52, 53, respectively, aligned along the y axis in sleeve 23. Pins 50, 51 are free to rotate but not to wobble within holes 52, 53.

The inner diameter of sleeve 23 is flattened at regions 54 and 55 in the vicinity of holes 52 and 53, respectively, to accommodate the rectangular shape of mass 19. The angle formed between the y axis passing through holes 52 and 53 of sleeve 23 and plate 13 is not critical.

Torque applied at hinge pin 15 is transmitted to torque transmit block 18 through pins 40, 41. Block 18 is free to rotate within cavity 20 about the x axis, but pins 40, 41 constrain holes 42, 43 to remain aligned along the x axis. The torque is transmitted from block 18 to yoke 10 through pins 50, 51. Holes 52, 53 allow sleeve 23 and hence yoke 10 to rotate about the y axis of block 18, but the holes 52, 53 are constrained to be aligned along the y axis. This arrangement provides two degrees of rotational freedom of yoke 10 with respect to yoke 8, one degree of freedom about each of the x and y axes.

Axial misalignment of hinge 5 along the z axis can be compensated for by means of clearance built in along the z axis, e.g., between washer 29 and end plate 30.

X, Y, and Z are the dimensions of central mass 19 along the x, y, and z axes, respectively. X′ and Z′ are the dimensions of central cavity 20 along the x and z axes, respectively. Y′ is the distance along the y axis between the two parallel surfaces 54 & 55 of sleeve 23, and is smaller than the inner diameter of sleeve 23 to allow rotation of block 18 about the y axis. X must be less than or equal to X′. If movement of block 18 along the x axis is not desired, x is made equal to X′. If a small amount of movement of block 18 along the x axis is desired, X is made to be less than X′. Z must be less than Z′. Y must be less than or equal to Y′. If movement of block 18 along the y axis is not desired, Y is made equal to Y′. If a small amount of movement of block 18 along the y axis is desired, Y is made to be less than Y′.

Rotation about the x axis (FIG. 4) is limited by the difference between Z and Z′, the geometry of block 18, and the clearance between sleeve 23 and sleeves 21, 31. Rotation about the y axis (FIG. 5) is limited by the clearance between the outer diameter of draw pin 15 and the inner diameter of sleeve 23. Rotation about the z axis is limited by the geometry of yokes 8, 10 and associated panels 3.

In assembling hinge 5, the following procedure is followed (see FIG. 6): Block 18 is inserted into central cavity 20 of hinge pin 15; x axis pins 40, 41 are inserted into block 18 through holes 42, 43, respectively; yokes 8 and 10 are positioned with respect to each other by means of suspending sleeve 23 between sleeves 21, 31; hinge pin 15 is inserted through sleeves 21, 23, and 31; and y axis pins 50, 51 are inserted into block 18 via holes 52, 53, respectively.

Figure 7:
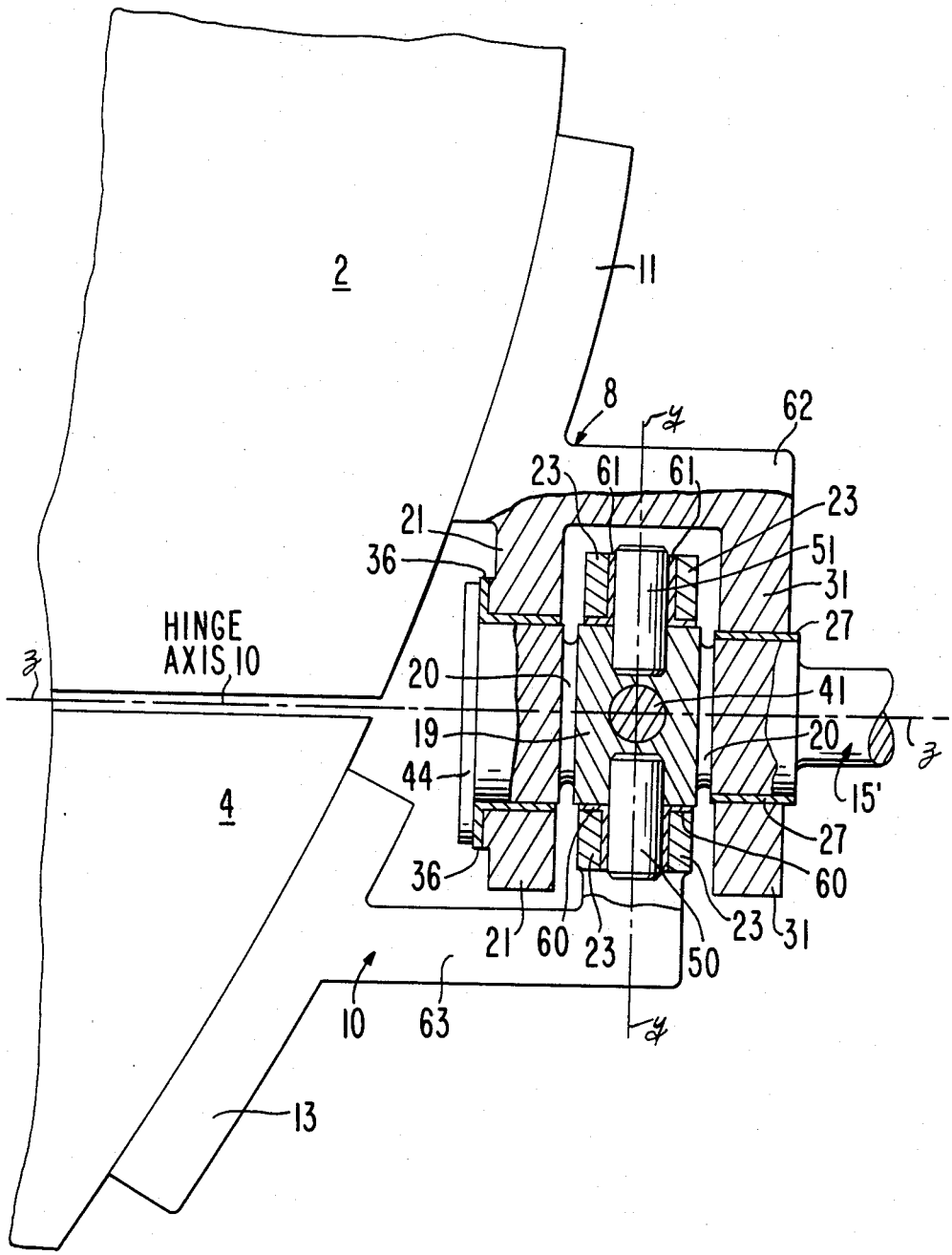
FIG. 7 is a partial cross-section view, looking down the x axis, of a fourth embodiment of hinge 5.

In the fourth embodiment of hinge 5, illustrated in FIG. 7, the hinge pin 15′ is unfixed along the z axis: as opposed to the previously described embodiments, no end plate 30 is used to cover the left end of flange 44. This fourth embodiment is designed to be used with a corresponding, but geometrically reversed, hinge 5 (not illustrated) on the left side of the z axis separating relatively stationary panel 2 and relatively rotating panel 4. No more than one of said two hinges 5 should use the depicted unfixed-in-z-axis hinge pin 15′. When this type of hinge pin 15′ is used, it can compensate for misalignment between panels 2 and 4 along the z axis.

Also shown in FIG. 7 is a combined axial/radial bearing 36 replacing washers 28, 29 and bushing 26 of the previous embodiments. If there are axial loads along the z axis moving from right to left in FIG. 7, there should be a matching but left-to-right-reversed bearing 36 on the hinge 5 (not illustrated) on the left of panels 2, 4.

A second (optional) combined axial/radial bearing 61 has been inserted about pin 51, and a third (optional) axial/raidal bearing 60 has been inserted around pin 50. Bearings 61 and 60 reduce friction.

None of the prior art hinges have the capability of self-aligning about two axes while allowing torque to be transmitted through the hinge. Advantages of hinge 5 of the present invention include:

The self-aligning capability of hinge 5 eliminates the requirement for precision alignment of two hinges 5 when they are used on opposing ends of an axis of rotation between two panels 3, thereby eliminating tight tolerance requirements during fabrication, and facilitating distortion-free assembly of the panels 3.

When the hinges 5 are used as untorqued hinges, they self-align about three orthogonal axes, x, y, and z.

Axial clearance can be built in along the z axis within hinge 5, compensating for axial misalignment in applications requiring this feature.

A torsion spring can be included around hinge pin 15, providing a self-folding or self-unfolding feature in addition to the self-aligning characteristics of hinge 5.

Limited motion of the panels 3 can be achieved by incorporating positive travel stops into the yokes 8, 10.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A self-aligning torque transmitting hinge comprising first and second yokes that are free to achieve different (with respect to each other) angular positions about a torquing axis;

means for self-aligning the hinge about first and second alignment axes that are orthogonal to each other and are generally orthogonal to the torquing axis, such that the first and second yokes partially rotate with respect to each other about each of the first and second alignment axes; and torquing means coupled to the hinge along the torquing axis, said torquing means being fixed with respect to the first yoke;

wherein the torquing means, when activated, transmits torque to the second yoke so that the second yoke rotates with respect to the first yoke about the torquing axis; wherein:

the first and second yokes are coupled to first and second antenna panels, respectively, so that relative rotation of the yokes about the torquing axis causes relative rotation of the panels about the torquing axis, permitting deployment of the antenna into a usable geometrical configuration.

2. A self-aligning torque transmitting hinge comprising first and second yokes that are free to achieve different (with respect to each other) angular positions about a torquing axis;

means for self-aligning the hinge about first and second alignment axes that are orthogonal to each other and are generally orthogonal to the torquing axis, such that the first and second yokes partially rotate with respect to each other about each of the first and second alignment axes; and torquing means coupled to the hinge along the torquing axis, said torquing means being fixed with respect to the first yoke;

wherein the torquing means, when activated, transmits torque to the second yoke so that the second yoke rotates with respect to the first yoke about the torquing axis; wherein:

the self-aligning means comprises a block having:

a central mass;

first alignment pins, rigidly connected to the central mass and disposed along the first alignment axis; and second alignment pins, rigidly connected to the central mass and disposed along the second alignment axis; wherein the block is free to pivot about each of its first and second alignment pins.

3. The hinge of claim 2 further comprising means for compensating for misalignments between the yokes in the direction along the torquing axis.

4. The hinge of claim 2 wherein the second yoke comprises a sleeve, generally having the shape of a hollowed-out cylinder, for holding the block, said sleeve having holes on opposing walls thereof for constraining the second alignment pins therein while permitting rotation of the second alignment pins within the holes, thereby allowing the second yoke to pivot about the second alignment axis.

5. The hinge of claim 2 further comprising an elongated hinge pin disposed along the torquing axis and having a central cavity for holding the block; wherein the first alignment pins fit within holes in that region of the hinge pin surrounding the central cavity, said hinge pin holes constraining the first alignment pins therewithin while permitting rotation of the first alignment pins within the hinge pin holes, thereby allowing the block and the second yoke to pivot about the first alignment axis.

6. The hinge of claim 5 wherein the first yoke further comprises a pair of sleeves axially aligned along the torquing axis, each of the first yoke sleeves having generally the shape of a hollowed-out cylinder;

the second yoke comprises a sleeve generally in the shape of a hollowed-out cylinder, said second yoke sleeve being positioned between the two first yoke sleeves in axial alignment therewith along the torquing axis;

the hinge pin fits within the three sleeves along the torquing axis, and is coupled to the torquing means; and the second alignment pins fit within holes on opposing walls of the second yoke sleeve, said second yoke holes constraining the second alignment pins therewithin while permitting rotation of the second alignment pins within the second yoke holes, thereby allowing the second yoke to pivot about the second alignment axis.

* * * * *